US011154758B2

(12) United States Patent
Herbert

(10) Patent No.: US 11,154,758 B2
(45) Date of Patent: Oct. 26, 2021

(54) POCKET STABILIZER FOR LACROSSE HEAD

(71) Applicant: BO-MER PLASTICS, LLC, Auburn, NY (US)

(72) Inventor: Thomas J. Herbert, Auburn, NY (US)

(73) Assignee: BO-MER PLASTICS, LLC, Auburn, NY (US)

( * ) Notice: Subject to any disclaimer, the term of this patent is extended or adjusted under 35 U.S.C. 154(b) by 0 days.

(21) Appl. No.: 16/573,710

(22) Filed: Sep. 17, 2019

(65) Prior Publication Data

US 2020/0360777 A1 Nov. 19, 2020

Related U.S. Application Data

(60) Provisional application No. 62/847,635, filed on May 14, 2019.

(51) Int. Cl.
*A63B 59/20* (2015.01)
*A63B 102/14* (2015.01)

(52) U.S. Cl.
CPC ..... *A63B 59/20* (2015.10); *A63B 2102/14* (2015.10)

(58) Field of Classification Search
CPC ..... A63B 67/06; A63B 65/00; A63B 9/20
See application file for complete search history.

(56) References Cited

U.S. PATENT DOCUMENTS 2,187,493 A * 1/1940 Taylor ..... A63B 65/00 473/609
3,507,496 A * 4/1970 Miller ..... A63B 67/06 273/339
4,007,555 A * 2/1977 Sasaoka ..... A63H 33/082 446/127
4,293,960 A * 10/1981 Palmaer ..... A42B 3/14 2/416
4,720,105 A * 1/1988 Ferrari ..... A63B 60/02 473/519
4,880,242 A * 11/1989 White ..... A63B 67/06 273/336
5,121,924 A * 6/1992 Reed ..... A63B 69/3632 156/250
5,405,135 A * 4/1995 Embro ..... A63F 9/12 273/157 R
5,702,105 A * 12/1997 Glikmann ..... A63F 9/0098 273/156

(Continued)

*Primary Examiner* — Eugene L Kim
*Assistant Examiner* — Christopher Glenn
(74) *Attorney, Agent, or Firm* — Barclay Damon LLP

(57) ABSTRACT

A pocket stabilizer for maintaining the spacing between the sidewalls of a lacrosse rim, comprising: a pair of ears each including an upper helix, a lower lobe and a medial segment disposed therebetween. The upper helix of the pair define a first dimension corresponding to a first sidewall spacing and the lower lobes of the pair define a second dimension corresponding to a second sidewall spacing. A stabilizing member is disposed between and integrates the medial segments of the pair of ears. The pocket stabilizer is placed within the pocket of the lacrosse head and slid downwardly into the throat such that the lower lobes and medial segments are wedged between the sidewalls of the lacrosse head rim to retain the shape of the rim and prevent plastic deformation thereof while the lacrosse head is not in use.

17 Claims, 7 Drawing Sheets

(56) References Cited

U.S. PATENT DOCUMENTS

| | | | | | |
|---|---|---|---|---|---|
| 5,826,279 | A * | 10/1998 | Tencer | A42B 3/10 | 2/181 |
| 5,846,137 | A * | 12/1998 | Tremblay | A63D 15/105 | 473/42 |
| 5,884,335 | A * | 3/1999 | Whittaker | A42B 1/002 | 2/195.5 |
| 6,652,390 | B2 * | 11/2003 | Bradford | A63B 60/02 | 473/341 |
| 2002/0000004 | A1 * | 1/2002 | Wise | A42B 3/14 | 2/416 |
| 2007/0163031 | A1 * | 7/2007 | Lewis, Jr. | A42B 3/127 | 2/414 |
| 2011/0167542 | A1 * | 7/2011 | Bayne | A42B 3/14 | 2/416 |
| 2012/0036620 | A1 * | 2/2012 | Harris | A42B 3/127 | 2/414 |
| 2012/0220398 | A1 * | 8/2012 | Martino | A63B 49/00 | 473/553 |
| 2014/0259312 | A1 * | 9/2014 | Moore | A42B 3/121 | 2/413 |
| 2015/0059055 | A1 * | 3/2015 | Johnson | A42B 3/10 | 2/181.4 |
| 2015/0129621 | A1 * | 5/2015 | Gray | A42B 1/002 | 223/25 |
| 2016/0029728 | A1 * | 2/2016 | Byrd | A42B 1/24 | 224/181 |
| 2016/0206034 | A1 * | 7/2016 | Degolier | A42B 3/127 | |
| 2016/0235133 | A1 * | 8/2016 | Chase, Jr. | A42B 1/08 | |

* cited by examiner

POCKET STABILIZER FOR LACROSSE HEAD

CROSS-REFERENCE TO RELATED APPLICATIONS

This application relates to commonly-owned, U.S. Design patent application, Ser. No. 29/691,145 entitled "POCKET STABILIZER FOR LACROSSE HEAD" filed on May 14, 2019. The contents of such application are included herein in their entirety.

PRIORITY CLAIM

This application claims the benefit of, and priority to, commonly-owned, U.S. Provisional patent application Ser. No. 62/847,635 entitled "POCKET STABILIZER FOR LACROSSE HEAD" filed on May 14, 2019. The contents of such application are included herein in their entirety.

COPYRIGHT NOTICE

Portions of this document may contain material which is subject to copyright protection. The copyright owner has no objection to the facsimile reproduction of the patent disclosure, as it appears in the Patent and Trademark Office patent files or records, but otherwise reserves all rights relating to the reproduction, distribution, copying and display of this copyrighted work.

TECHNICAL FIELD

The present invention relates to: (i) lacrosse sticks for use in the recreational game of lacrosse, and more particularly, (ii) a device for stabilizing the contour of a lacrosse head, and more particularly, (iii) a device for stabilizing the pocket/sidewalls thereof such that a game ball will not be inadvertently caught or retained in the pocket following a face-off or other passing maneuver.

BACKGROUND

In the game of lacrosse, the lacrosse ball is set in play during a face-off where opponents face one another while a field umpire places the ball between the lacrosse sticks of each opponent. Oftentimes, a field expert known as a "FOGO" (an acronym for Face-Off-Get-Off) may be used, sometimes exclusively, during face-off maneuvers to obtain control of the field of play by winning the face-off contest. Since this has become such a specialized position, it is not uncommon for the FOGO, who may have great upper-body strength and control, to Get Off or leave the field of play in favor of a faster, more agile, midfielder or attackers to continue play.

The face-off is characterized by a combination of strength and quickness as the FOGO forcibly overpowers his opponent while gaining control over the game ball. This activity places significant strain on the head of the lacrosse stick which can lead to deformation of its, shape, contour and sidewall-spacing, i.e., the dimension between the sidewalls of the pocket. Inasmuch as the lacrosse head becomes geometrically misshaped, there is a propensity for the ball to get "stuck" or inadvertently held in place when attempting to pass the lacrosse ball downfield. A new, recently established rule, penalizes teams victimized by "a stuck ball" if the ball cannot be released before the player takes more than one step, by requiring that the ball be "turned-over" to the other team. Such turnovers can easily determine the outcome of the contest.

In addition to the stresses/strain placed on the lacrosse-head during a game/contest, it is not uncommon for a lacrosse-stick to be randomly packed in the trunk of a vehicle with other heavy lacrosse gear. While in transit, or simply awaiting a game scheduled in the future, the lacrosse head may be twisted or misshaped. While the lacrosse head may not be exposed to the same stresses as may be incurred during face-offs, lower strain over a longer period of time can result in "creep" which can be equally damaging to the contour of a lacrosse head. Accordingly, the head of a lacrosse stick can be misshaped, whether or not, in the hands of a FOGO and poses similar risk associated with turnovers caused by a game ball being held between the sidewalls of the lacrosse head.

The foregoing describes some, but not necessarily all, of the problems, disadvantages and shortcomings related to lacrosse head contour stabilization. Accordingly, there is a need to otherwise eliminate or lessen the disadvantages discussed above.

SUMMARY

In a first embodiment, a pocket stabilizer is provided for maintaining the spacing between the sidewalls of a lacrosse rim comprising a pair of ears each including an upper helix, a lower lobe and a medial segment disposed therebetween. The upper helix of the pair define a first dimension corresponding to a first sidewall spacing while the lower lobes of the pair define a second dimension corresponding to a second sidewall spacing. Furthermore, a stabilizing member is disposed between the medial segments to connect the ears, thereby forming a uniform, integral structure.

In a second embodiment, a method is provided for stabilizing a lacrosse head while the lacrosse stick is not in use. The method includes the step of: configuring a pocket stabilizer to include a pair of ears each having an upper helix, a lower lobe and a medial segment disposed therebetween. The upper helix of the pair define a first dimension corresponding to a first sidewall spacing, while the lower lobes of the pair define a second dimension corresponding to a second sidewall spacing. The medial segments define a varying dimension corresponding to a sidewall taper causing the first sidewall spacing to be larger than the second sidewall spacing. In another step, the pocket stabilizer is placed within the pocket of the lacrosse head between the first and second sidewall spacing dimensions of the lacrosse head. In a final step, the lower lobes of the ears are thrust or urged downwardly into a throat region of the lacrosse head between the second sidewall spacing dimension of the lacrosse head. The ears are wedged between the sidewalls of the lacrosse head rim to retain the shape of the rim and prevent plastic deformation thereof while the lacrosse head is not in use.

As used, the pocket stabilizer is placed within the pocket of the lacrosse head and slid downwardly into the throat such that the lower lobes and medial segments are wedged between the sidewalls of the lacrosse head. While in place, the pocket stabilizer retains the shape of the rim and prevents plastic deformation thereof while the lacrosse head is not in use.

Additional features and advantages of the present disclosure are described in, and will be apparent from, the following Brief Description of the Drawings and Detailed Description.

DETAILED DESCRIPTION

This disclosure is directed to a device configured to retain, maintain and prevent deformation of a lacrosse head. The device is configured to ensure that the pocket of the lacrosse head continues to perform as intended, even after play which may distort or deform the shape and/or spacing between the sidewall structures and/or the pocket of the lacrosse head.

Figure 2:
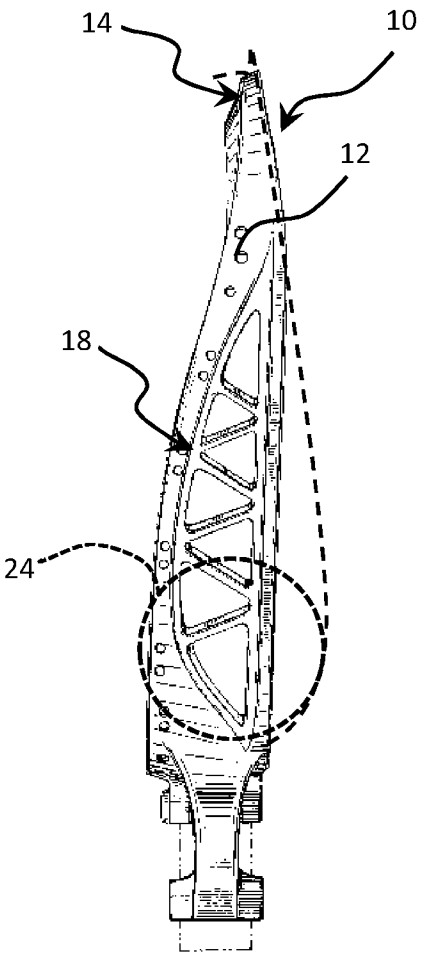
FIG. 2 is a side view of the structural rim depicted in FIG. 1.
Figure 1:
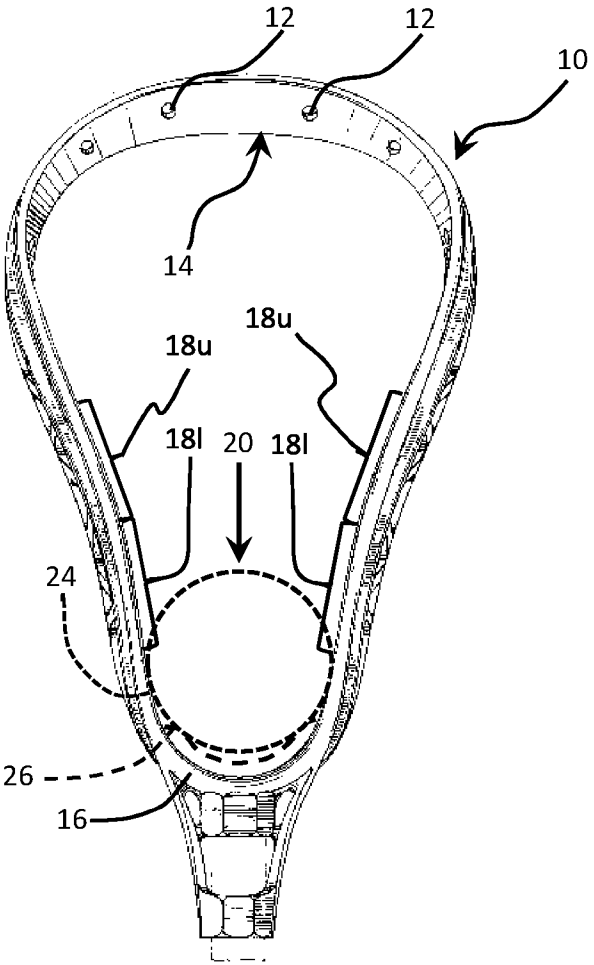
FIG. 1 depicts a structural rim of a lacrosse head including a scoop, sidewalls, and ball stop support, which structural rim accepts a mesh weave (not shown) to form a pocket for catching, throwing and cradling a lacrosse ball.
Figure 3:
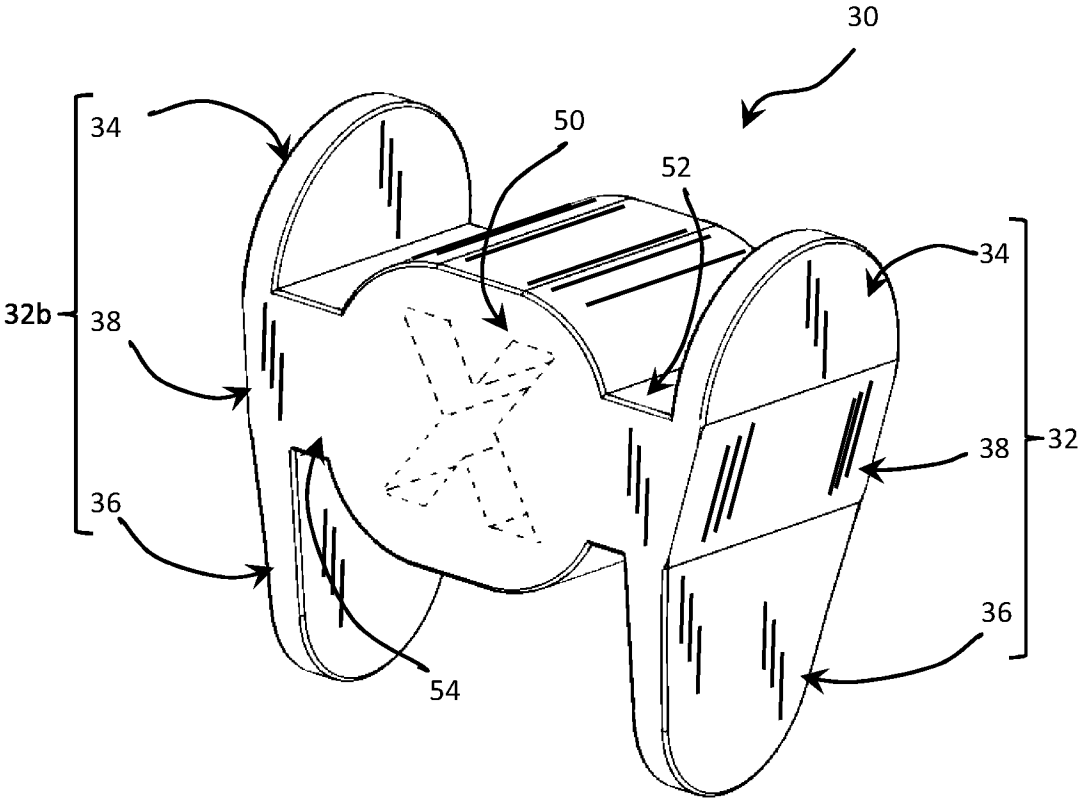
FIG. 3 is an isolated perspective view of a pocket stabilizer according to one embodiment of the disclosure for maintaining the contour of the lacrosse head such that a threshold spacing is maintained between the sidewall surfaces of the structural rim while the lacrosse stick is not in use.
Figure 5:
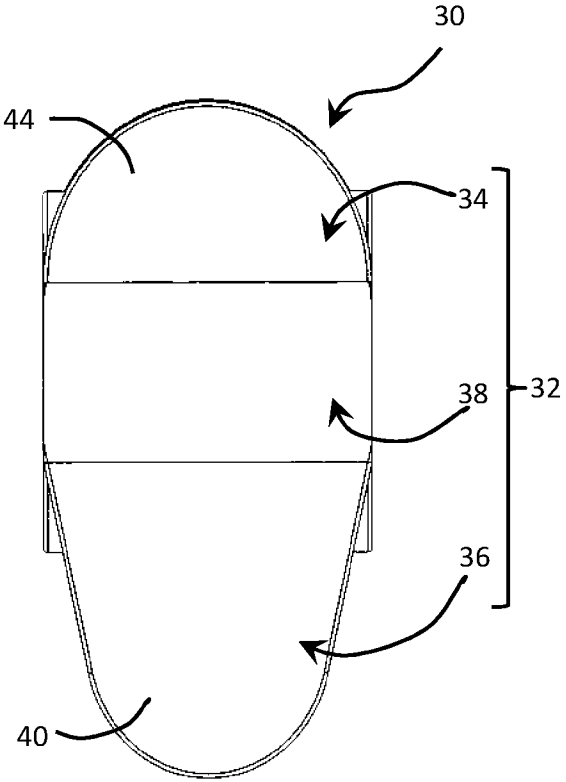
FIG. 5 is a side view of the pocket stabilizer depicted in FIG. 4 of the disclosure.
Figure 4:
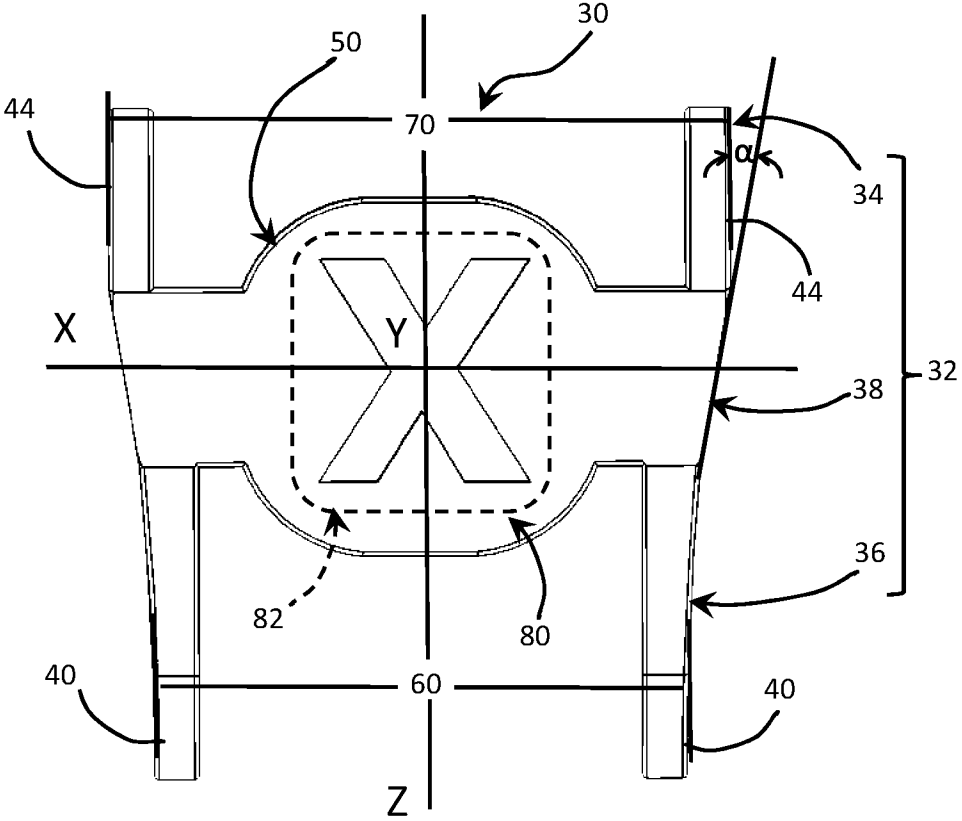
FIG. 4 is a front view of the pocket stabilizer depicted in FIG. 3 of the disclosure.
Figure 6:
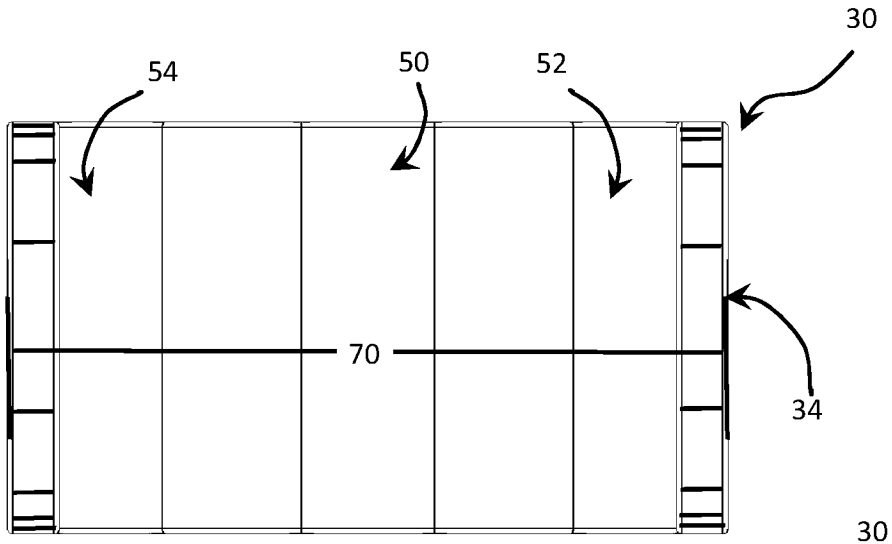
FIG. 6 is a top view of the pocket stabilizer depicted in FIG. 4 of the disclosure.
Figure 7:
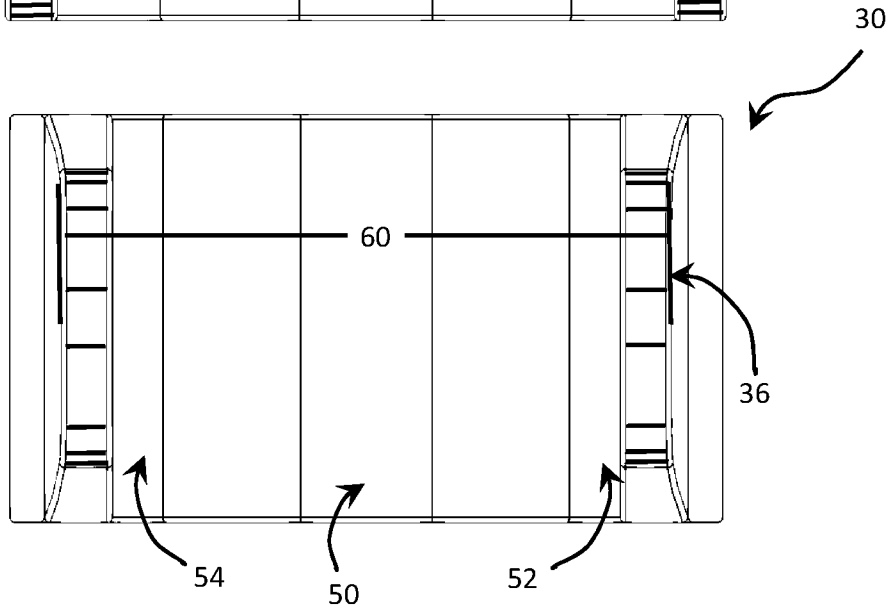
FIG. 7 is a bottom view of the pocket stabilizer depicted in FIG. 4 of the disclosure.
Figure 9:
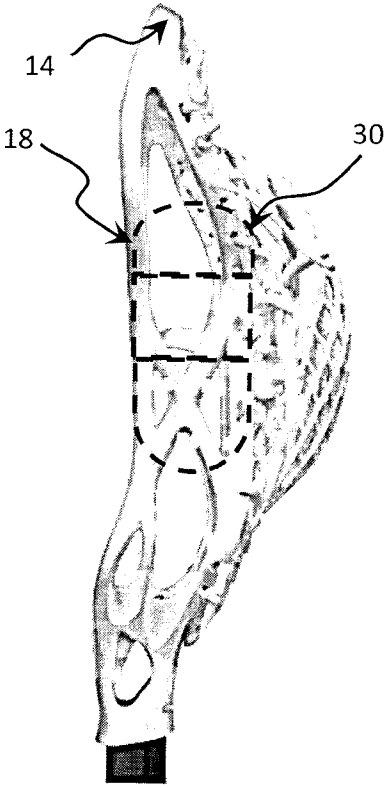
FIG. 9 is a side view of the structural rim depicted in FIG. 8 showing the pocket stabilizer in position to maintain the spacing between the sidewall surfaces when the lacrosse stick is not in use.
Figure 8:
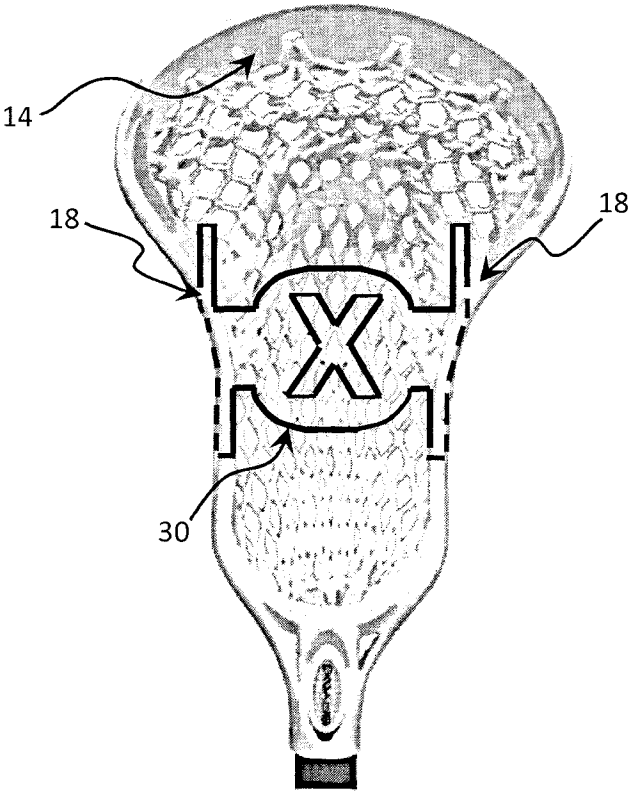
FIG. 8 is a front view of the structural rim showing a pocket stabilizer in position to maintain the dimension between the sidewalls while the lacrosse stick is not in use.

In FIG. 1, a typical lacrosse rim 10 is depicted for use in combination with a lacrosse-stick (not shown). Inasmuch as the rim 10 is synonymous with the lacrosse head, the terms lacrosse "rim" and lacrosse "head" will be used interchangeably throughout the disclosure. The mesh, which ties to the rim 10 via a plurality of apertures 12, has been removed to reveal the various portions of the rim 10. The rim 10 comprises a scoop 14, ball stop support 16, and opposing sidewalls 18 which define a throat 20. The scoop 14 is typically used to spoon a lacrosse ball 20 into the pocket from the ground while the opposing sidewalls 18 guide the ball 24 into the throat 18. The ball comes to rest upon a ball stop 26 (shown in phantom) which is supported by a U-shaped ball stop support 16 opposite the scoop 14 of the rim 10. The scoop 14 is, of course, used in other aspects of the game including guiding the ball when throwing, passing or taking a shot on goal.

Inasmuch as the rim 10 is typically fabricated from a thermoplastic resin matrix, the rim 10 is subject to distortion and deformation as a consequence of ground/player contact and/or storage among heavy objects which can easily damage the rim if its weight is placed across the opposing sidewalls. Such affects are discussed in the Background section of this disclosure.

FIGS. 2 through 6 depict one embodiment of a pocket stabilizer 30 in accordance with the teachings of the present disclosure. The pocket stabilizer 30 includes a pair of ears 32*a*, 32*b* each comprising an upper helix 34, a lower lobe 36 and a medial segment 38 disposed therebetween. In the described embodiment, the outwardly facing surface of each ear 32*a*, 32 is configured to abut the sidewalls 18 of the lacrosse rim 10. At minimum, the outwardly facing surface of, at least the medial segments 38, contacts the sidewalls 18 of the rim 10. More specifically, the pocket stabilizer 30 is configured to fit between the sidewalls 18, i.e., in the upper portion of the rim 10 near the scoop 14, such that the lower lobes 38 may slide downwardly into the throat portion 20 of the lacrosse head 10. As such, the medial segments 36 are wedged between the sidewalls 18 of the lacrosse rim 10 to retain the shape of the rim 10 and prevent plastic deformation thereof while the lacrosse head 10 is not in use.

In the described embodiment, the medial segment 38 is inclined, i.e., forms a linearly variable taper, such that least some portion of the inclined surface will engage, support and retain the shape of the lacrosse head 10. In the described embodiment taper may vary from about five degrees (5°) to about twenty degrees (20°). While a linearly variable taper is depicted, it will be appreciated that a curvilinear shape may be employed to provide the same functionality as the inclined surface.

The outer facing or external surface of each of the lower lobes 38 define a first dimension 60 corresponding to a first sidewall spacing. The sidewall spacing of the rim 10 is measured is between the sidewalls 18*u*, i.e., from one side to the opposing side. This spacing of the pocket stabilizer 30 is a threshold dimension measured between the external surface of one lobe 38, associated with a first ear 32*a*, and the external surface of the opposite lobe 38 associated with the second ear 32*b*. In the described embodiment, the threshold spacing associated with the lower lobes 38 is between about two and three quarter inches (2.75") to about three and one quarter inches (3.25"). More specifically, the threshold spacing between the lower lobes 38 is about three inches (3.0").

The outer facing or external surface of each of the upper helixes 34 defines a second dimension 70 which is larger than the first dimension 60. The larger second dimension 70 accommodates the inclination of the medial segments 36 which allows the taper to open or expand as a consequence of the throat 20 opening, i.e., from small to large as the throat opens from bottom to top. Notwithstanding the difference in length dimension from the first to the second dimensions 60, 70, the first and second dimensions will vary from between about two and three quarter inches (2.75") to about three-quarter inches (3.75"). In at least one embodiment, the first and second dimensions may vary from between about three inches (3.0") to about three and one-half inches (3.5"). That is, the dimensions preferably remain to ensure that the lacrosse ball will not be held, caught-up or "stuck" due to a deformed or distorted throat region of the pocket.

As a consequence of the throat dimensions, the pocket stabilizer 30 is symmetric about a vertical Z axis, but is asymmetric about a horizontal X axis. Both the spacing along the X axis and the length along the Z axis is different such that the pocket stabilizer 10 is asymmetric about the horizontal X axis. This is dominated by the throat dimension (see FIG. 4) which varies in width dimension (along the X axis), height dimension (along the Z axis), and depth dimension (along the Y axis—out of the plane of the page in FIG. 4).

The pocket stabilizer 30 provides adequate support between the sidewall structure 18 of the lacrosse head 30 by employing compliant/resilient materials in its manufacture. More specifically, the pocket stabilizer 30 comprises highly compliant lobes along the upper and lower ends of the stabilizer 30 to facilitate ease of installation while ensuring that the stabilizer remains bedded or secure between the sidewall structures 18 of the lacrosse rim 30. In the described embodiment, the upper helix and lower lobes 34, 38 are fabricated from compliant materials selected from the group of: Acrylonitrile-Butadiene-Styrene (ABS), polycarbonate ABS, urethane and polyurethane.

In another embodiment, the stabilizing member 50 may include an I-shaped web defining a recessed surface or cavity 84 configured to accept a team logo or other aesthetic symbol. For example, the stabilizing member 50, which extends across the pocket stabilizer, may include an enlarged outwardly facing surface 84S so as to facilitate the artwork of a team logo or other aesthetic. In this embodiment, the outwardly facing surface 84S includes the tradename "FLEXFORCE" wherein the "X" forms the handle of the lacrosse stick. While a tradename is depicted, it will be appreciated that this surface is ideal for engraving team logos and/or a player's team number. Furthermore, the cavity 84 is defined by the I-shaped web and upper and lower lateral protrusions 52 (see FIG. 10) integrating the web with the medial segment of each ear.

Similar to the previous embodiment, the stabilizing member includes a pair of ears 32*a*, 32*b* each defining an upper helix 34, a lower lobe 36 and a medial segment 38 disposed between the upper helix 34 and the lower lobe 36. While, in the previous embodiment, i.e., the embodiment shown in FIG. 3, the medial segment 38 provided the requisite taper to accommodate the shape of the structural rim 14, the medial segment 38 and lower lobes 36 of the present embodiment are configured to share the necessary contour changes. In this embodiment, the medial segment 38 tapers by an angle θ of three degrees (3°) while the lower lobe 36 tapers by a much larger angle β of nine and eight tenths degrees (9.8°). Accordingly, the medial segment 38 and lower lobe 36 of each ear 32*a*, 32*b* produce the collective taper required to accommodate the contour changes of the lacrosse head 10, i.e., the sidewalls 18*u*, 18*i* of the rim 14.

Figure 10:
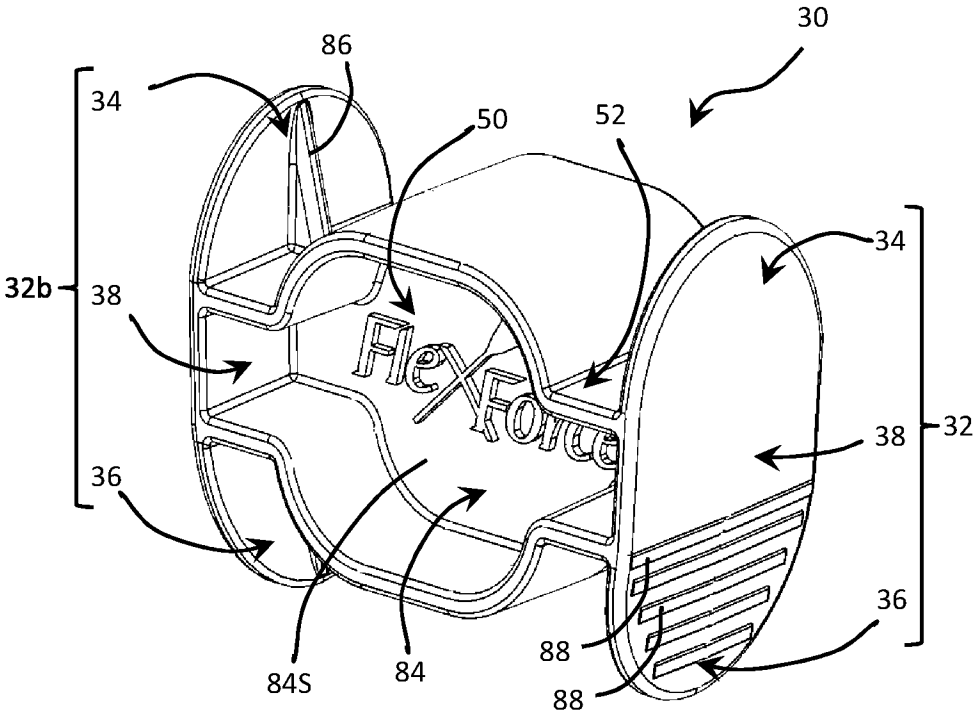
FIG. 10 is an isolated perspective view of another embodiment of the pocket stabilizer wherein stiffening webs augment the rigidity of the upper helix and lower lobes of the pocket stabilizer and horizontal ridges augment frictional engagement of the outwardly facing surfaces of the ears with the structural rim of the lacrosse head to maintain the position of the pocket stabilizer when in use.
Figure 12:
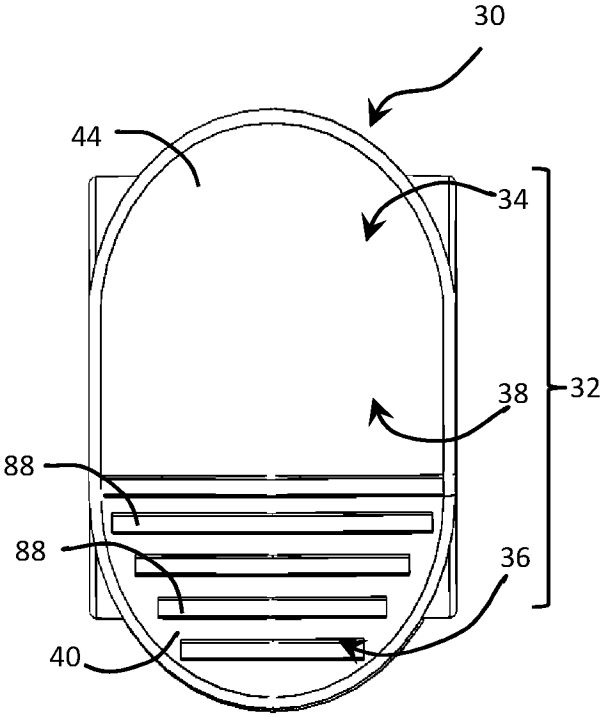
FIG. 12 is a side view of the pocket stabilizer depicted in FIG. 10 of the disclosure.
Figure 11:
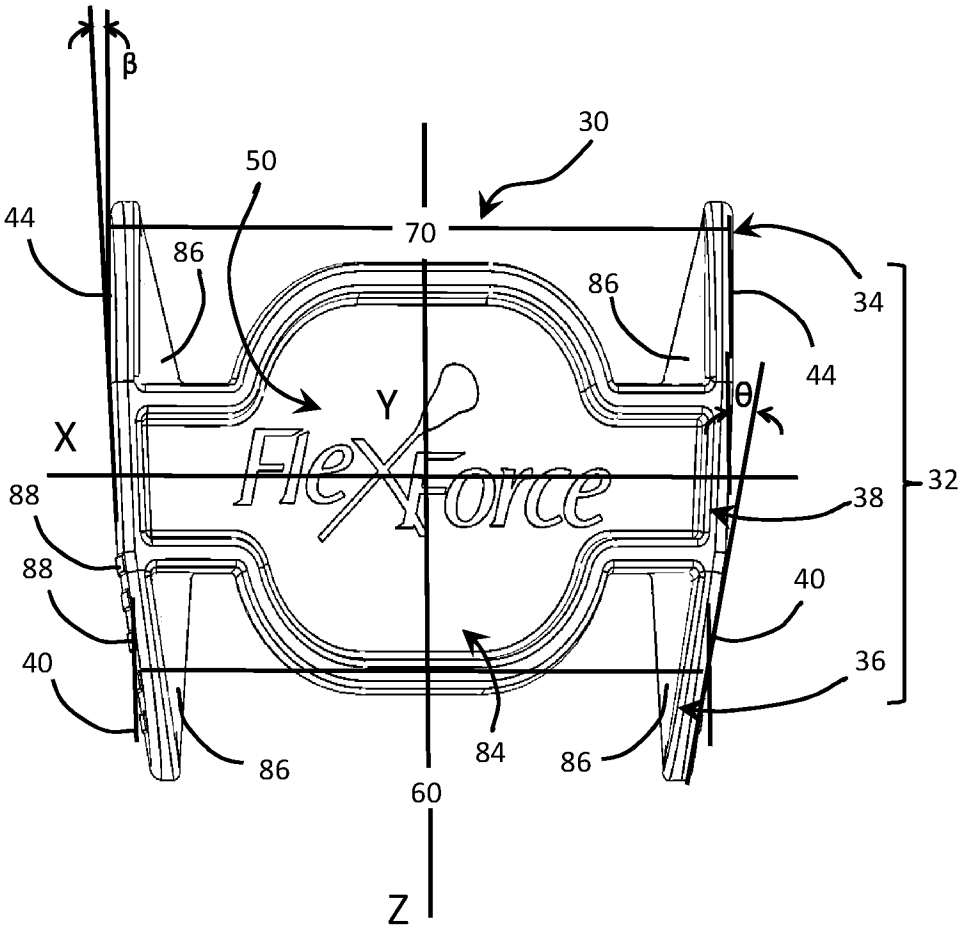
FIG. 11 is a front view of the pocket stabilizer depicted in FIG. 10 of the disclosure.

To enhance the structural stiffness of the pocket stabilizer 30 depicted in FIG. 10, a web stiffener 86 is included at the upper corner of each upper helix 34 and the lower corner of each lower lobe 38, More specifically, a triangular-shaped web 86 structurally interconnects each upper helix 34 with an upper side of the stabilizing member 50 and each lower lobe 38 with the lower side of the stabilizing member 50. Additionally, to ensure that the pocket stabilizer 30 adequately and effectively engages the sidewall 18*u*, 18I of the rim 14, the outer surface 40 of each lower lobe 38 is configured with a plurality of horizontal ridges 88 which function to enhance the frictional engagement or efficacy of the outer surface 40 with the corresponding sidewall structure 18*u*, 18I of the rim 14. In the described embodiment, the ridges 88 project outwardly from about 0.025 inches to about 0.125 inches from the outer surface 40.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A pocket stabilizer for a lacrosse head, comprising: a pair of ears each including an upper helix, a lower lobe and a medial segment disposed therebetween, the upper helix of the pair defining a first dimension corresponding to a first sidewall spacing, lower lobes of the pair defining a second dimension corresponding to a second sidewall spacing, and the medial segments defining a varying dimension corresponding to a sidewall taper causing the first sidewall spacing to be larger than the second sidewall spacing; and a stabilizing member disposed between and integrating the medial segments of the pair of ears, the stabilizing member extends across an X-axis and having a web member extending along a Y-axis; the lower lobe of each ear having a characteristic stiffness about the X and Y axes; wherein the characteristic stiffness is greater about the X axis than about the Y-axis such that each lower lobe is laterally compliant to facilitate insertion of the pocket stabilizer within a pocket of the lacrosse head.

2. The pocket stabilizer of claim 1, wherein the stabilizing member includes a web defining a surface configured to accept a team logo or other aesthetic symbol.

3. The pocket stabilizer of claim 1, wherein the stabilizing member includes a cavity for receiving an object.

4. The pocket stabilizer of claim 3, wherein the cavity is defined by a web, and upper and lower lateral protrusions integrating the web with the medial segment of each ear.

5. The pocket stabilizer of claim 1, wherein the upper helix and lower lobe of each ear are laterally compliant about the web member to facilitate variations in the sidewall taper of a rim portion of the lacrosse head.

6. The pocket stabilizer of claim 1, wherein the taper varies from five degrees (5°) to fifteen degrees (15°).

7. The pocket stabilizer of claim 1, wherein the upper helix and lower lobe each define a height dimension from a distal edge of each to the stabilizing member and wherein the height dimension to the distal edge of the lower lobe is greater than a length dimension to the distal edge of the upper helix.

8. The pocket stabilizer of claim 1, wherein the upper helix and lower lobe of each ear are fabricated from a compliant material selected from the group consisting of: Acrylonitrile-Butadiene-Styrene (ABS), polycarbonate ABS, urethane and polyurethane.

9. The pocket stabilizer of claim 1, wherein the ears are symmetric about a vertical Z axis and asymmetric about a horizontal X axis.

10. A pocket stabilizer, comprising: a pair of ears each including an upper helix, a lower lobe and a medial segment disposed therebetween, the medial segment including an outwardly facing surface configured to abut a sidewall surface of a lacrosse head, a plurality of horizontal ridges projecting from the outwardly facing surface of each lower lobe to enhance engagement with a corresponding sidewall surface of the lacrosse head; and a stabilizing member disposed between and integrating the medial segments of the pair of ears, wherein the stabilizing member defines a housing having a cavity for receiving an object; wherein the pocket stabilizer is placed within a pocket of the lacrosse head and slid downwardly into a throat portion thereof such that the lower lobes and medial segments are wedged between a sidewall of the lacrosse head to retain its shape and prevent plastic deformation of a rim portion of the lacrosse head while not in use.

11. The pocket stabilizer of claim 10, wherein the stabilizing member includes a web member defining a surface configured to accept a team logo or other aesthetic symbol.

12. The pocket stabilizer of claim 10, further comprising lateral protrusions integrated with a web of the stabilizing member and with a medial segment of each ear.

13. The pocket stabilizer of claim 10, wherein the upper helix and lower lobe of each ear are laterally compliant about the web axis of the stabilizing member to facilitate variations in the sidewall taper of a rim portion of the lacrosse head.

14. The pocket stabilizer of claim 10, wherein the taper varies from five degrees (5°) to fifteen degrees (15°).

15. The pocket stabilizer of claim 10, wherein the upper helix and lower lobe of each ear are fabricated from a compliant material selected from the group consisting of: Acrylonitrile-Butadiene-Styrene (ABS), polycarbonate ABS, urethane and polyurethane.

16. The pocket stabilizer of claim 10, wherein the ears are symmetric about a vertical Z axis and asymmetric about a horizontal X axis.

17. The pocket stabilizer of claim 10, further comprising a triangular-shaped stiffening web disposed between, and integrated with, the lateral protrusions of the stabilizing member and each pair of ears, the triangular shaped stiffening web tapering from each of the upper and lower lateral protrusions to a distal portion of each upper helix and lower lobe, respectively.

* * * * *